US010844668B2

(12) United States Patent
Gonzalez

(10) Patent No.: US 10,844,668 B2
(45) Date of Patent: Nov. 24, 2020

(54) SELF-ALIGNING WET CONNECTION CAPABLE OF ORIENTING DOWNHOLE TOOLS

(71) Applicant: National Oilwell Varco, L.P., Houston, TX (US)

(72) Inventor: Abraham Gonzalez, Cedar Park, TX (US)

(73) Assignee: National Oilwell Varco, L.P., Houston, TX (US)

( * ) Notice: Subject to any disclaimer, the term of this patent is extended or adjusted under 35 U.S.C. 154(b) by 125 days.

(21) Appl. No.: 16/185,671

(22) Filed: Nov. 9, 2018

(65) Prior Publication Data

US 2020/0149357 A1 May 14, 2020

(51) Int. Cl.

| | |
|---|---|
| ***E21B 17/02*** | (2006.01) |
| ***H01R 13/00*** | (2006.01) |
| ***E21B 17/10*** | (2006.01) |
| ***E21B 17/042*** | (2006.01) |

(52) U.S. Cl.

CPC ..... *E21B 17/028* (2013.01); *E21B 17/042* (2013.01); *E21B 17/1078* (2013.01); *H01R 13/005* (2013.01)

(58) Field of Classification Search

CPC .... E21B 17/028; E21B 17/003; E21B 17/021; E21B 17/1078; E21B 17/0283; E21B 17/0285

See application file for complete search history.

(56) References Cited

U.S. PATENT DOCUMENTS

| | | | |
|---|---|---|---|
| 4,126,848 | A | 11/1978 | Denison |
| 5,131,464 | A | 7/1992 | Lenhart et al. |
| 5,358,418 | A | 10/1994 | Carmichael |
| 5,389,003 | A | 2/1995 | Van Steenwyk et al. |
| 5,967,816 | A | 10/1999 | Sampa et al. |
| 6,062,905 | A | 5/2000 | Sampa et al. |
| 6,510,899 | B1 | 1/2003 | Sheiretov et al. |
| 6,511,335 | B1 | 1/2003 | Rayssiguier et al. |
| 2005/0070141 | A1 | 3/2005 | Dopf et al. |
| 2006/0283606 | A1 | 12/2006 | Partouche et al. |
| 2011/0061934 | A1 | 3/2011 | Jekielek |
| 2013/0008669 | A1 | 1/2013 | Deere et al. |
| 2015/0041149 | A1 | 2/2015 | Deere et al. |

(Continued)

FOREIGN PATENT DOCUMENTS

| | | | |
|---|---|---|---|
| GB | 2410513 | A | 8/2005 |

OTHER PUBLICATIONS

Coleman Brown, Tips & Tricks: High-Siding, Orienting, and Seating your MWD, Web page https://tolteq.com/?p=4559, Apr. 2, 2014.

*Primary Examiner* — Catherine Loikith

(74) *Attorney, Agent, or Firm* — Jonathan Pierce; Pierre Campanac; Porter Hedges LLP

(57) ABSTRACT

For transmitting signals from a collar based tool to an MWD tool string, the collar based tool is connected to an adapter having a wet connector at its end, and the MWD tool string is connected to a centralizer having another wet connector at its end. The adapter includes a rotatable portion that can be oriented in a predetermined orientation, for example, a direction related to the high side of the bent housing of a mud motor tool. The centralizer and the adapter are stabbed together, thus mating the wet connectors. During stabbing, the MWD tool string orients itself with the predetermined orientation. Also, the wet connectors align themselves.

18 Claims, 9 Drawing Sheets

(56) References Cited

U.S. PATENT DOCUMENTS

| | | | |
|---|---|---|---|
| 2015/0308258 | A1 | 10/2015 | Logan et al. |
| 2016/0359262 | A1 | 12/2016 | Kenison et al. |
| 2017/0044840 | A1 | 2/2017 | Deere et al. |
| 2017/0184731 | A1 | 6/2017 | Deere et al. |
| 2017/0328137 | A1 | 11/2017 | Perry et al. |

SELF-ALIGNING WET CONNECTION CAPABLE OF ORIENTING DOWNHOLE TOOLS

CROSS-REFERENCE TO RELATED APPLICATIONS

None

BACKGROUND

The disclosure is related to systems and methods for connecting downhole tools. In particular, these systems and methods may facilitate the orientation of the downhole tools relative to a reference line, such as the high side of the bent housing of a mud motor tool.

Measurement-While-Drilling ("MWD") tool strings are used in the oil and gas industry to provide various measurements to the driller. These measurements can be transmitted in real-time to the earth surface using a telemetry system, such as including a mud pulser, to provide real-time data. These measurements can help the driller to place the well, that is, to direct the drill bit as it cuts into the earth.

MWD tool strings typically include sensors encapsulated inside metal housings that are centralized in drill collars, as well as a telemetry system. In contrast with downhole tools that make an MWD tool string, the sensors of a collar based tool (e.g., a resistivity tool) are not encapsulated inside metal housings that can be introduced into the collars, but these sensors are built on a collar. Thus, the connection between an MWD tool string and a collar based tool involves a collar connection that is made on the drill rig, typically while the collar based tool is held in slips and the MWD tool string is suspended above the collar based tool.

Accordingly, the connection between an MWD tool string and a collar based tool is sometimes made in hazardous conditions, such as in the presence of drilling fluids (e.g., conductive fluids) around the connectors. Connectors suitable for connections in these environments are sometimes referred to as "wet connectors." For example, US Pub. No. 2005/0070141 describes two connector halves matingly engageable in a co-axial arrangement, where the electrical contacts on each of the connectors are physically covered for protecting electrical contacts on each of said connectors from environmental damage. Electrical switching circuits are connected to the electrical contacts situated on one or both of said connectors. Such electrical switching circuits serve to prevent the flow of electrical power to respective electrical contacts in any, or both, said connectors until the connectors are fully mated. Through the electrical switches, the multiple electrical contacts of the connectors are electrically isolated (i.e. "switched off") as they slide past one another, and are only electrically powered after mating engagement is complete. A spring may further be provided to exert a force and ensure that the connectors remain fully mated while allowing for some variation in the length of the collars.

Further, when the connection between the MWD tool string and the collar based tool is keyed, it may be necessary to mechanically ensure that electrical contacts on two downhole tools are correctly aligned before the connection. For example, US Pub. No. 2016/0359262 describes first and second electrical couplers each having a plurality of electrical contacts oriented for linear engagement. The electrical contacts of the second electrical coupler are mounted on a first portion of the second electrical coupler which is rotatably received by a second portion to enable linear engagement of the electrical contacts while rotating the components relative to each other to form the mechanical connection.

MWD tool strings include directional sensors (e.g., magnetometers, inclinometers, gyroscopes). Directional or other sensors are typically oriented relative to the high side of the bent housing of a mud motor tool. Therefore, centralizers for MWD tool strings may allow for the rotation of the tool string relative to the drill collars. For example, US Pub. No. 2013/0008669 describes a centralizer having an outer housing with stabilizing fins. An inner housing has a first electrical connector at its first end and a second electrical connector at its second end. The outer housing has threaded rings for threadedly attaching with sleeves of downhole tools. The threaded rings can rotate independently from the outer housing and the inner housing, and the inner housing can be independently rotated within the outer housing.

Despite these advances in the art, there is still a need for systems and methods for connecting downhole tools that facilitate the orientation of the downhole tools relative to a reference line, such as the high side of the bent housing of a mud motor tool. Preferably, connections can be made in the presence of conductive fluids around the connectors, and electrical contacts on two sides of the connection are correctly aligned before the connection without requiring an operator for manually aligning the electrical contacts.

BRIEF SUMMARY

The disclosure describes systems for connecting downhole tools.

The systems may comprise a first tubular body comprised, for example, in a centralizer. A first wet connector may be disposed inside an end of the first tubular body. A first switch connector may be disposed inside the first tubular body. The first switch connector may be translatably fixed relative to the first wet connector. A second switch connector may be disposed inside the first tubular body. The first switch connector may be movable between a first position wherein the first switch connector is electrically insulated from the second switch connector and a second position wherein the first switch connector is electrically connected to the second switch connector. A first biasing means may be capable of biasing the first switch connector in the first position. The first switch connector and the second switch connector may be sealed within the first tubular body by seals, which may be provided on the first wet connector and on a bulkhead. A plurality of centralizer fins may be coupled around the first tubular body by a cylindrical joint, or preferably a revolute joint. In some embodiments, a key may protrude from a surface of the end of the first tubular body. In other embodiments, a keyway may be recessed from a surface of the end of the first tubular body. Preferably, the keyway may comprise a funnel surface, which may include two helical surfaces having opposite handedness and two straight surfaces each adjacent to one of the two helical surfaces. The helical surfaces may be adjacent to an apex surface essentially diametrically opposed to the two straight surfaces.

The systems may comprise a second tubular body comprised, for example, in an adapter. A first portion and a second portion of the second tubular body may be coupled by a cylindrical joint, or preferably a revolute joint. A second wet connector may be disposed inside an end of the second portion. The second wet connector may be configured to electrically connect with the first wet connector. A second biasing means may be coupled to the second wet connector. The second biasing means may preferably be stiffer than the first biasing means that biases the first switch connector in the first position. A first rotatable connector may be coupled to the first portion. A second rotatable connector may be coupled to the second portion. The first rotatable connector may be electrically connected to the second rotatable connector. The second wet connector may be electrically connected to the second rotatable connector. The first rotatable connector and the second rotatable connector may be sealed within the second tubular body by seals, which may be provided on the second wet connector and on a bulkhead. A centralizer ring may be disposed around the second portion and be rotatably fixed relative to the second portion. In embodiments where a key protrudes from a surface of the end of the first tubular body, a keyway may be recessed from a surface of the end of the second tubular body, and the keyway may be rotatably fixed relative to the second portion and the centralizer ring. Preferably, the keyway may comprise a funnel surface, which may include two helical surfaces having opposite handedness and two straight surfaces each adjacent to one of the two helical surfaces. The helical surfaces may be adjacent to an apex surface essentially diametrically opposed to the two straight surfaces. Conversely, in other embodiments where a keyway is recessed from the surface of the end of the first tubular body, a key may protrude from a surface of the end of the second tubular body, and the key may be rotatably fixed relative to the second portion and the centralizer ring. The key and the keyway may be configured to align the first wet connector with the second wet connector and simultaneously orient the first tubular body in a predetermined direction after the key has engaged the keyway.

The systems may comprise a drill collar, which may have a bore sized to receive the centralizer ring. A setting means may be coupled to a wall of the drill collar. In use, the setting means may be engaged with the centralizer ring to hinder a rotation of the centralizer ring relative to the drill collar.

The disclosure describes methods for connecting downhole tools.

The methods may comprise the steps of receiving the centralizer ring, which may be disposed around, and rotatably fixed relative to, the second portion of the second tubular body in the bore of the drill collar.

The methods may comprise the steps of rotating the second portion of the second tubular relative to the first portion of the second tubular to orient either the key or the keyway in a predetermined direction, and selectively engaging the centralizer ring with the setting means coupled to the wall of the drill collar to hinder further rotation of the centralizer ring and the second portion relative to the drill collar. While the second portion is rotated relative to the first portion, the optional second rotatable connector may simultaneously rotate relative to the optional first rotatable connector.

The methods may comprise the steps of engaging the key with the keyway, aligning the first wet connector with the second wet connector while simultaneously orienting the first tubular body in the predetermined direction after the key has engaged the keyway; and electrically connecting the first wet connector with the second wet connector after the first connector is aligned with the second wet connector. While the first tubular body is oriented in the predetermined direction, the first tubular body may simultaneously rotate relative to the optional plurality of centralizer fins. After the first wet connector is electrically connected with the second wet connector, the optional first switch connector may move from the first position wherein the first switch connector is electrically insulated from the optional second switch connector, to the second position wherein the first switch connector is electrically connected to the second switch connector after the first wet connector is electrically connected with the second wet connector. After the first switch connector has moved to the second position, the second biasing means may optionally be compressed.

BRIEF DESCRIPTION OF THE DRAWINGS

For a more detailed description of the embodiments of the disclosure, reference will now be made to the accompanying drawings, wherein.

DETAILED DESCRIPTION

Figure 1:
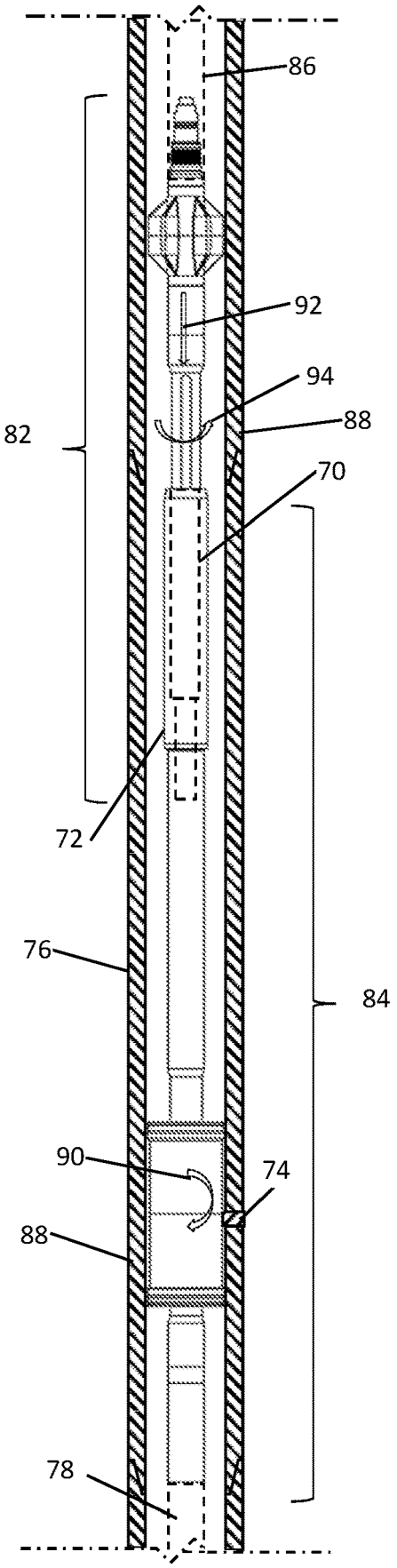
FIG. 1 is an elevation view, partially in cross-section, of a system for connecting a first downhole tool to a second downhole tool.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

All numerical values in this disclosure may be approximate values unless otherwise specifically stated. Accordingly, various embodiments of the disclosure may deviate from the numbers, values, and ranges disclosed herein without departing from the intended scope. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 illustrates in ghost line a first downhole tool 86, for example at the end of an MWD tool string, and a second downhole tool 78, for example at the end of a collar based tool. The first downhole tool 86 and second downhole tool 78 may be part of a drill string 88, which may be made of several drill collars, such as drill collar 76, that are threaded together. The drill string 88 may be terminated by a mud motor (not shown) having a bent housing and being connected to a drill bit (not shown). The first downhole tool 86 may include a battery module, a gamma ray module, a survey module, and/or a telemetry module, for example, a mud pulser. The second downhole tool 78 may include a resistivity module or other Logging-While-Drilling module.

For transmitting signals from the second downhole tool 78 to the first downhole tool 86, the first downhole tool 86 may be electrically connected to the second downhole tool 78 using a connector system as described herein. Thus, measurements performed by the resistivity module or the Logging-While-Drilling module may be broadcasted to a surface operator using a telemetry module included in the MWD toll string. Further, during the connection between the first downhole tool 86 and the second downhole tool 78, the MWD tool string, including the first downhole tool 86, may preferably orient itself in a predetermined orientation, for example, a direction related to the high side of the bent housing of a mud motor tool. Thus, the directional sensors of a survey module, which may be included in the MWD tool string, may automatically be oriented relative to the high side of the bent housing.

For example, the connector system used for connecting the first downhole tool 86 to the second downhole tool 78 may include a centralizer 82 having a first tubular body mechanically connected to the first downhole tool 86, and an adapter 84 having a second tubular body mechanically connected to the second downhole tool 78. In use, a pin end 70 of the centralizer 82 may stab into a box end 72 of the adapter 84, as indicated by arrow 92, whereby the first downhole tool 86 may be connected to the second downhole tool 78.

Further, the adapter 84 may include a revolute joint that may permit orienting one of a key or a keyway in the predetermined orientation, as indicated by arrow 90. A setting means, such as set screw 74, may be coupled to the drill collar 76. In use, the setting means may be engaged to hinder further rotation after the key or the keyway is oriented in the predetermined orientation. The centralizer 82 may include the other of the key or a keyway. The key sliding along the keyway may cause the centralizer 82 to rotate, as indicated by arrow 94, thus aligning a connector of the centralizer 82 with a connector of the adapter 84, while simultaneously orienting the centralizer 82 and the first downhole tool 86 connected thereto in the predetermined direction.

Figure 2A:
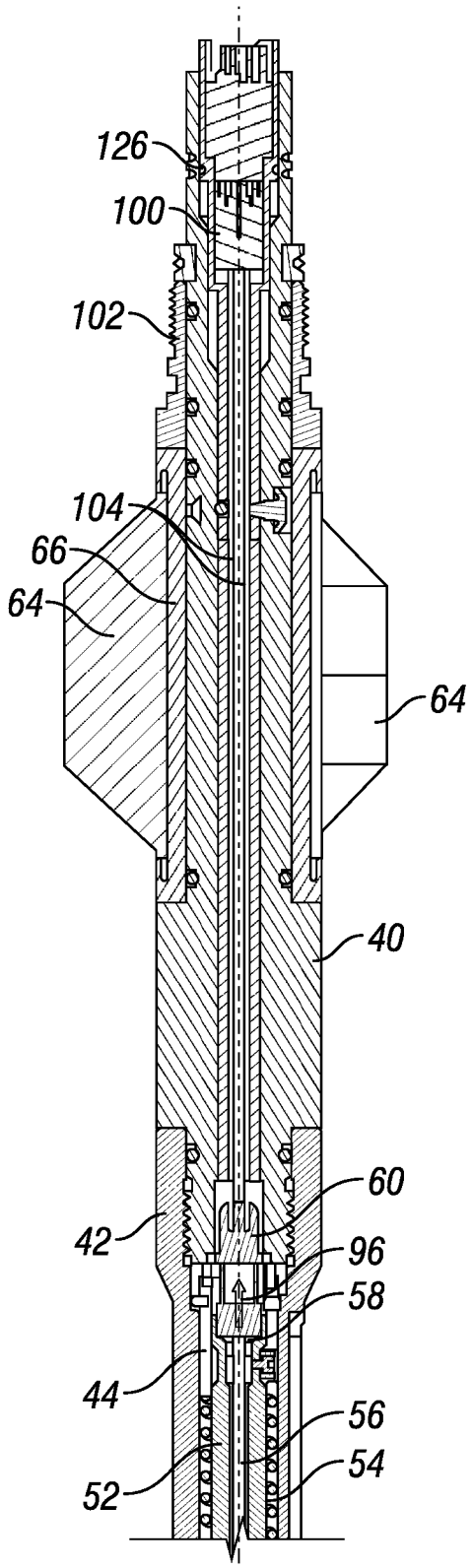
FIGS. 2A-2B are partial, sectional views of a centralizer shown in FIG. 1.
Figure 2B:
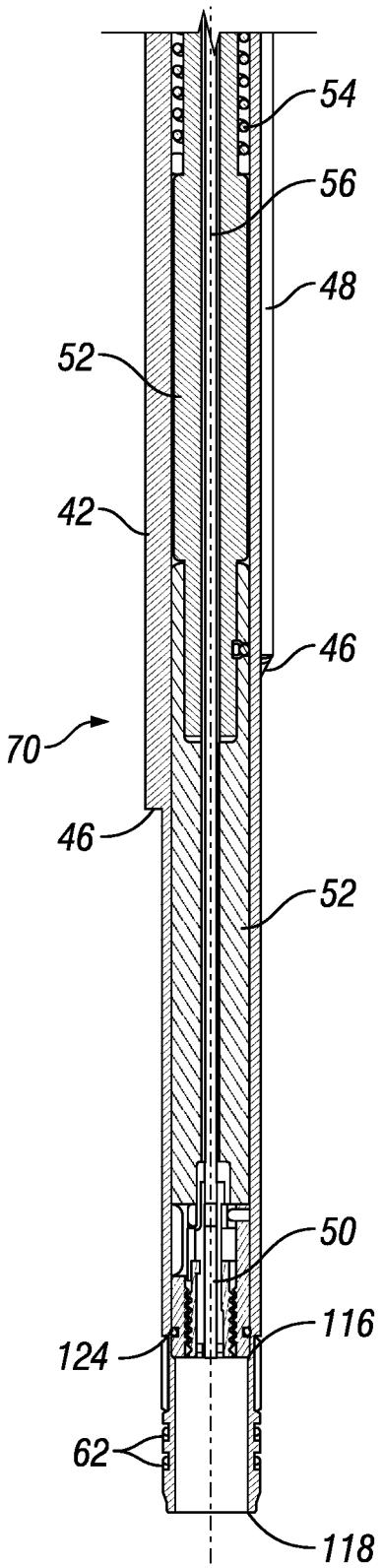
Figure 4:
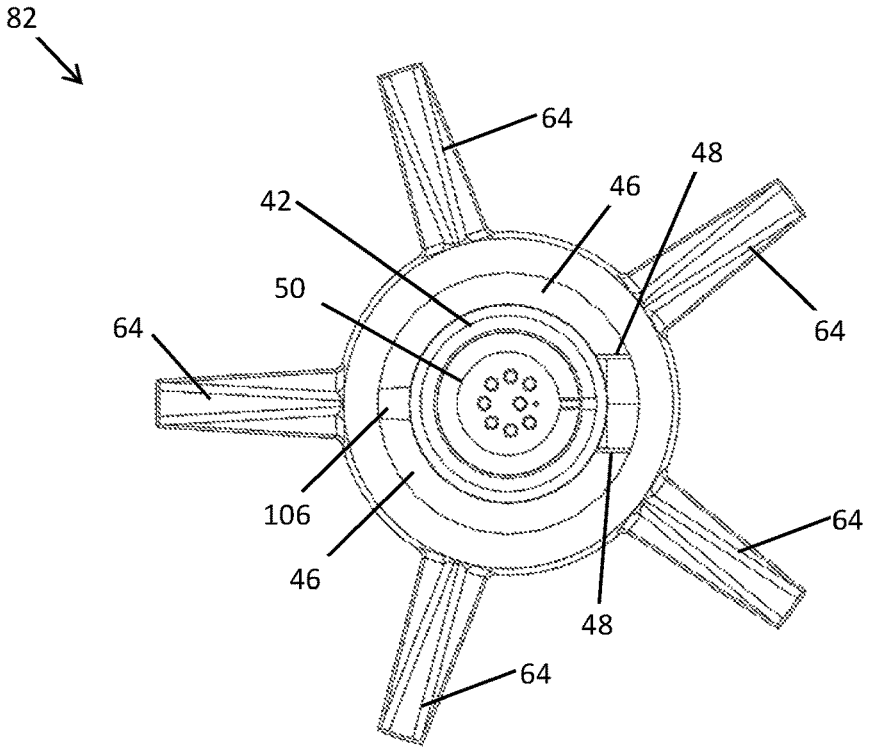
FIG. 4 is a bottom view of the centralizer shown in FIGS. 2A-2B.

FIGS. 2A-2B and 4 illustrate the centralizer 82 shown in FIG. 1. The centralizer 82 may include a first tubular body formed by a first centralizer housing 40 and a second centralizer housing 42 threaded thereto. A plurality of centralizer fins 64 may be sized to engage an inner bore surface of the drill string 88 (shown in FIG. 1). The plurality of centralizer fins 64 may be coupled around the first tubular body by a revolute joint. For example, the centralizer fins 64 may be affixed to a rotatable support 66 disposed around the first centralizer housing 40. As such, the first tubular body may rotate relative to the plurality of centralizer fins 64. Further, for connecting the first downhole tool 86 (shown in FIG. 1) to the centralizer 82, a mechanical connector 102 may be provided at one end of the first tubular body, which is opposite to the pin end 70. As such, rotation of the first tubular body may cause the same rotation of the first downhole tool 86 (and optionally same rotation of the MWD tool string).

A first shaft 52 may be disposed in the second centralizer housing 42. A first switch connector 58 (e.g., a male concentric connector) may be affixed to one end of the first shaft 52, and a first wet connector 50 (e.g., a multi-socket connector) may be affixed to the other, opposite end of the first shaft 52. As used herein, a wet connector is a connector suitable for connections in the presence of fluids around the connectors. A first wire harness 56 may electrically connect the first switch connector 58 to the first wet connector 50. The first shaft 52 may slide but not rotate relative to the second centralizer housing 42. As such, the first switch connector 58 and the first wet connector 50 may translate in unison within the second centralizer housing 42, or in other words, the first switch connector 58 may be translatably fixed relative to the first wet connector 50. For example, the first shaft 52 may be held at one end inside a first bushing 44 affixed to the second centralizer housing 42, and may be affixed at the other end to the first wet connector 50, which in turn may be disposed inside the pin end 70 of the first tubular body such that it may slide but not rotate relative to the pin end 70. A first biasing means, for example, a spring 54 or other known compressible, resilient device and/or material, may be capable of biasing the first shaft 52 away from the first centralizer housing 40, for example until the first wet connector 50 abut a shoulder inside the second centralizer housing 42. The shoulder 116 may preferably be configured such that the first wet connector 50 is sufficiently recessed within the second centralizer housing 42. Thus, contact of pin end 70 of the first tubular body with the adaptor 84 (e.g., with a second wet connector 20 shown in FIG. 3A) first occurs at an extremity 118 of the second centralizer housing 42 and subsequently at the sockets of the first wet connector 50.

A second switch connector 60 (e.g., a female concentric connector) may be affixed to one end of the first centralizer housing 40. An electrical connector 100 (e.g., a spring-loaded, bulkhead connector) may be disposed in the other, opposite end of the first centralizer housing 40. Conductors 104 may electrically connect the second switch connector 60 to the electrical connector 100.

For selectively preventing the flow of electrical power between the electrical connector 100 and the first wet connector 50 before the first wet connector 50 is fully engaged, the first switch connector 58 may be movable between a first position wherein the first switch connector 58 is electrically insulated from the second switch connector 60, and a second position wherein the first switch connector 58 is electrically connected to the second switch connector 60, as indicated by arrow 96. The spring 54 may be capable of biasing the first switch connector 58 in the first position. Further, the first switch connector 58 and the second switch connector 60 may be sealed within the first tubular body by seals 124, 126, which may be provided on an outer diameter of the first wet connector 50 and an outer diameter of the bulkhead of the electrical connector 100. As such, the first switch connector 58 and the second switch connector 60 are not required to be wet connectors.

Figure 6A:
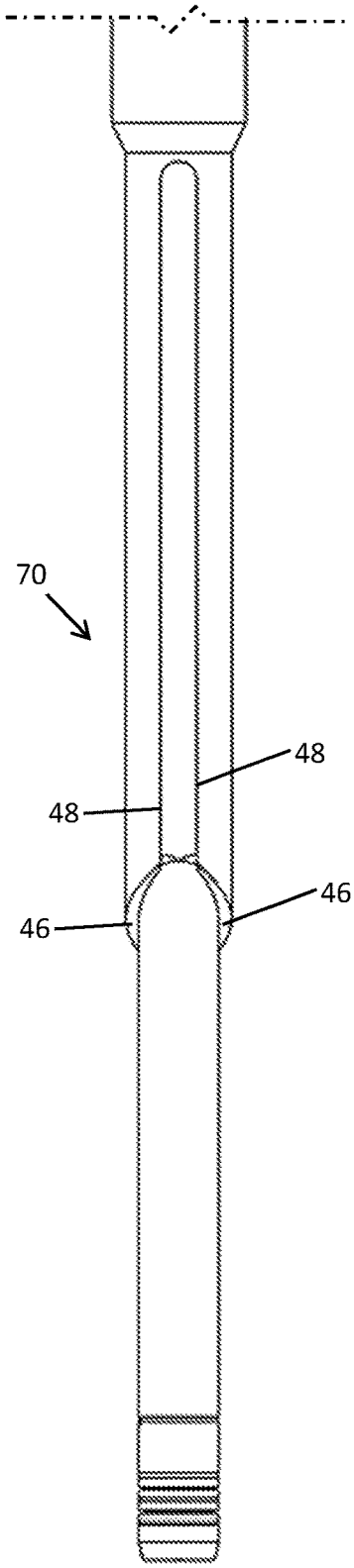
FIGS. 6A-6C are respectively a right view, a frontal view, and a left view of an end of the centralizer shown in FIGS. 2A-2B.
Figure 6B:
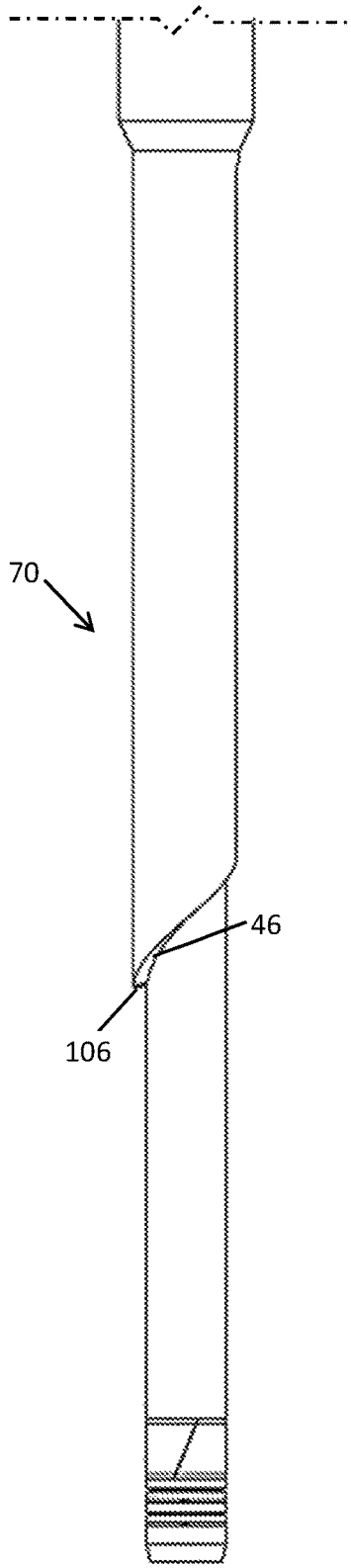
Figure 6C:
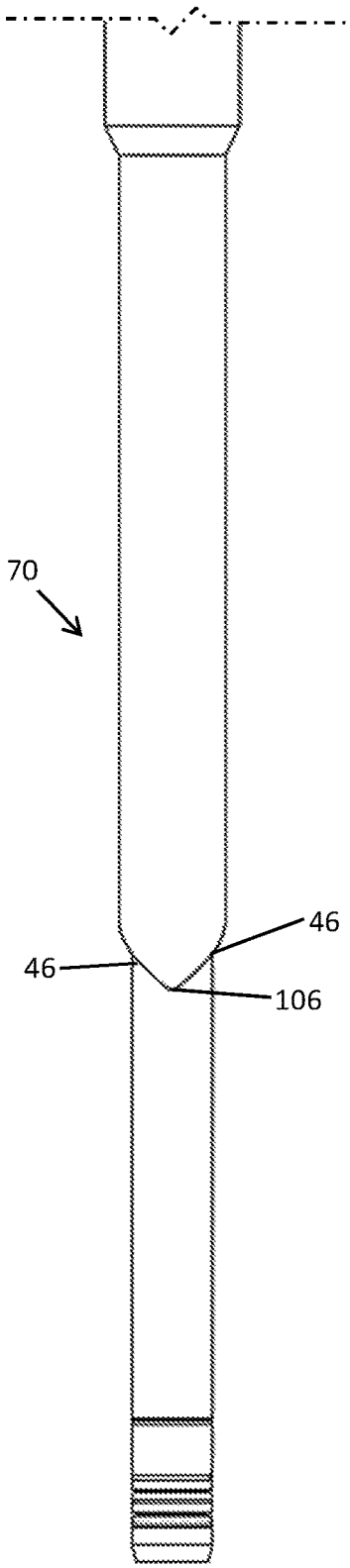

A keyway may be recessed from an outer surface of the pin end 70 of the first tubular body. For example, as illustrated in FIGS. 6A-6C, the keyway may comprise a funnel surface, which may include two helical surfaces 46 having opposite handedness and two straight surfaces 48, each adjacent to one of the two helical surfaces 46. The helical surfaces 46 may span a substantial portion of the circumference of the pin end 70. The helical surfaces 46 may be adjacent to an apex surface 106 essentially diametrically opposed to the two straight surfaces.

Figure 3A:
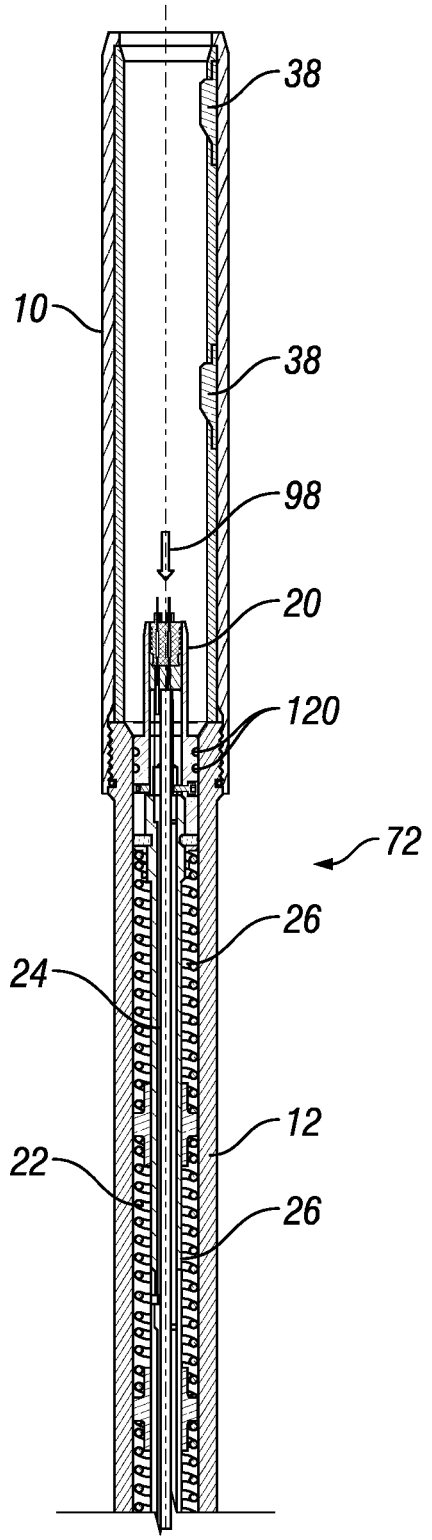
FIGS. 3A-3B are sectional views of an adapter shown in FIG. 1.
Figure 3B:
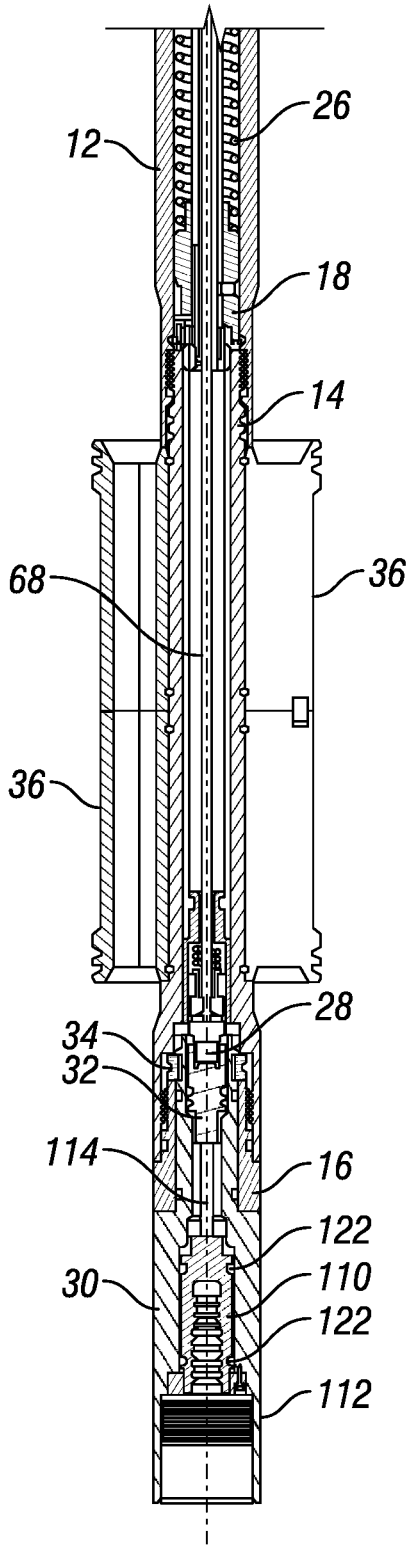
Figure 5:
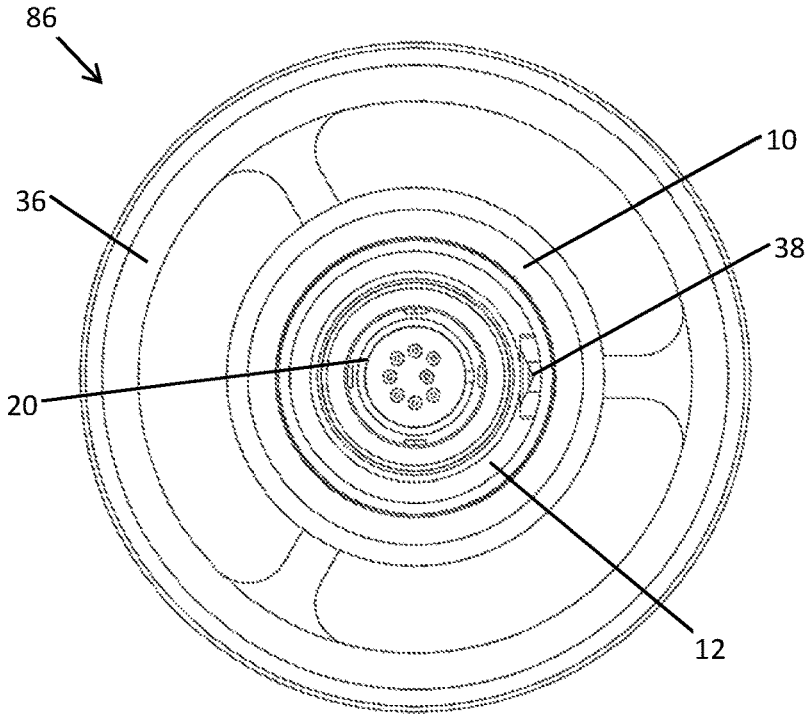
FIG. 5 is a top view of the adapter shown in FIGS. 3A-3B.

FIGS. 3A-3B and 5 illustrate the adapter 84 shown in FIG. 1. The adapter 84 may comprise a second tubular body having a first portion and a second portion. The first portion may be formed by an adapter sleeve 10, a first adapter housing 12, a second adapter housing 14 and a thread ring 16. The first adapter housing 12, the second adapter housing 14 and the thread ring 16 may be threaded together. The adapter sleeve 10 may be keyed and locked to the first adapter housing 12. The second portion may be formed by the third adapter housing 30. A centralizer ring 36 may be disposed around the second adapter housing 14. The centralizer ring 36 may be rotatably fixed relative to the second adapter housing 14. Further, for connecting the second downhole tool 78 (shown in FIG. 1) to the adapter 84, a mechanical connector 112 may be provided at one end of the second tubular body, which is opposite to the box end 72.

A second wet connector 20 (e.g., a multi-pin connector) that is configured to mate with the first wet connector 50 may be disposed inside the box end 72 of the second portion of the second tubular body such that it may slide but not rotate relative to the box end 72. A second shaft 22 may be disposed in the first adapter housing 12 and may be affixed to the second wet connector 20. The second shaft 22 may slide but not rotate relative to the second centralizer housing 42. For example, the second shaft 22 may be held at one end inside a second bushing 18 affixed to the first adapter housing 12 and may be affixed at the other end to the first wet connector 50, which in turn may be disposed inside the box end 72 of the second tubular body such that it may slide but not rotate relative to the box end 72. A second biasing means, for example, a spring 26 or other known compressible, resilient device and/or material, may be capable of biasing the second connector toward the adapter sleeve 10, for example until the first wet connector 50 abut a shoulder inside the first adapter housing 12. A second wire harness 24, which may be connected to the second wet connector 20, may include a deformable portion 68, such as a coiled portion similar to a telephone cord. As such, upon compression of the spring 26 and contraction of the deformable portion 68 of the second wire harness 24, the second wet connector 20 may be pushed away from the adapter sleeve 10 by a nose of the pin end 70 (shown in FIG. 2B), as indicated by arrow 98. Thus, the second wet connector 20 may be fully engaged with the first wet connector 50 while allowing variations of the distance between the first downhole tool 86 (shown in FIG. 1) and the second downhole tool 78 (also shown in FIG. 1). Further, O-rings 62 (shown in FIG. 2B) provided around the nose of the pin end 70 may slide into a bore of the first adapter housing 12 and seal against an inner surface of the first adapter housing 12 when the pin end 70 is stabbed into the box end 72.

For rotating the second portion relative to the first portion, the first portion and the second portion of the second tubular body may be coupled by a revolute joint. For example, the revolute joint may be formed using a split ring 34 inserted in an outer groove of the third adapter housing 30 and locked between a shoulder of the thread ring 16 and a shoulder of the second adapter housing 14. Further, a first rotatable connector 32 may be coupled to one end of the third adapter housing 30. The first rotatable connector 32 may be electrically connected to an electrical connector 110 (e.g., a bulkhead connector) disposed in the other, opposite end of the third adapter housing 30 via conductor 114. A second rotatable connector 28 may be coupled to an end of the second adapter housing 14. The second wet connector 20 may be electrically connected to the second rotatable connector 28 via a second wire harness 24. The first rotatable connector 32 may be electrically connected to the second rotatable connector 28. Further, the first rotatable connector 32 and the second rotatable connector 28 may be sealed within the second tubular body by seals 120, 122, which may be provided on an outer diameter of the second wet connector 20 and on an outer diameter of the bulkhead of the electrical connector 110. As such, the first rotatable connector 32 and the second rotatable connector 28 are not required to be wet connectors.

One or more keys 38 may protrude from an inner surface of the box end 72 of the second tubular body, and the one or more keys 38 may be rotatably fixed relative to the adapter sleeve 10, the first adapter housing 12, the second adapter housing 14, the thread ring 16, and the centralizer ring 36. The one or more keys 38 engage the keyway (e.g., the keyway formed by the two helical surfaces 46, the two straight surfaces 48, and the apex surface 106 shown in FIGS. 2B, and 6A-6C). The one or more keys 38 and the keyway may be configured to align the sockets of first wet connector 50 with the pins of second wet connector 20 and simultaneously orient the first tubular body in a predetermined direction.

While the embodiment of FIGS. 1-6 shows one or more keys 38 protruding from an inner surface of the box end 72 of the second tubular body, and a keyway being recessed from an outer surface of the pin end 70 of the first tubular body, in alternative embodiments, the one or more keys 38 may conversely protrude from an outer surface of the pin end 70 of the first tubular body, the keyway may be recessed from an inner surface of the box end 72 of the second tubular body.

Further, while the embodiment of FIGS. 1-6 shows the centralizer 82 including a first tubular body having a pin end 70 engaging a box end 72 of the adapter 84, in alternative embodiments, the pin end 70 may be flipped and provided on the adapter 84 and, the box end 72 may similarly be flipped and provided on the centralizer 82. In these alternative embodiments, the wet connector coupled to the centralizer 82 preferably, but not necessarily, remains a female connector (e.g., a multi-socket connector), and the wet connector coupled to the centralizer 82, preferably, but not necessarily, remains a male connector (e.g., a multi-pin connector). Also, the second biasing means may preferably, but not necessarily, bias the wet connector coupled to the box end, and thus, may be provided in the tubular body of the centralizer 82.

Still further, the male and female portions of the rotatable connector comprised in the adapter 84, and/or the male and female portions of the switch connector comprised in the centralizer 82 may be interchanged.

Still further, while the embodiment of FIGS. 1-6 shows revolute joints that may not permit translation between joined parts, in alternative embodiments, cylindrical joints may also permit relative translation between joined parts. Accordingly, the support 66 and the plurality of centralizer fins 64 may rotate around and slide along the first centralizer housing 40 forming the first tubular body. Also, the third adapter housing 30 forming the first portion of the second tubular body may rotate and slide within the second adapter housing 14 forming the second portion of the second tubular body, in which cases the spilt ring 34 and the thread ring 16 may be modified or omitted.

FIGS. 7-10 illustrate a sequence of steps of a method for connecting downhole tools. In this example, a resistivity tool may be connected to a mud motor (not shown) having a bent housing. An operator may have visualized the high side of the bent housing using a scribe line 80 drawn on the collar of the resistivity tool. An MWD tool string may then be connected to the resistivity tool using the system shown in FIGS. 1-6, such that the MWD tool string may be oriented relative to the scribe line 80. Preferably, the connection can be made even in the presence of drilling fluids around the connector coupled to the MWD tool string or the connector coupled to the resistivity tool, without requiring the operator for manually aligning the connector coupled to the MWD tool string with the connector coupled to the resistivity tool.

Figure 7:
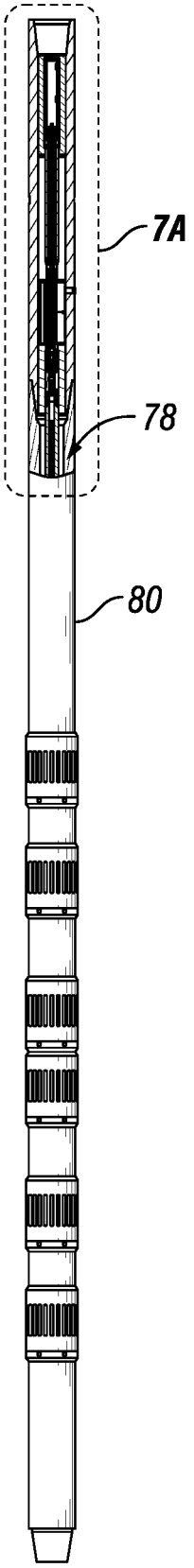
FIGS. 7-10B illustrate a sequence for connecting the first downhole tool to the second downhole tool.
Figure 7A:
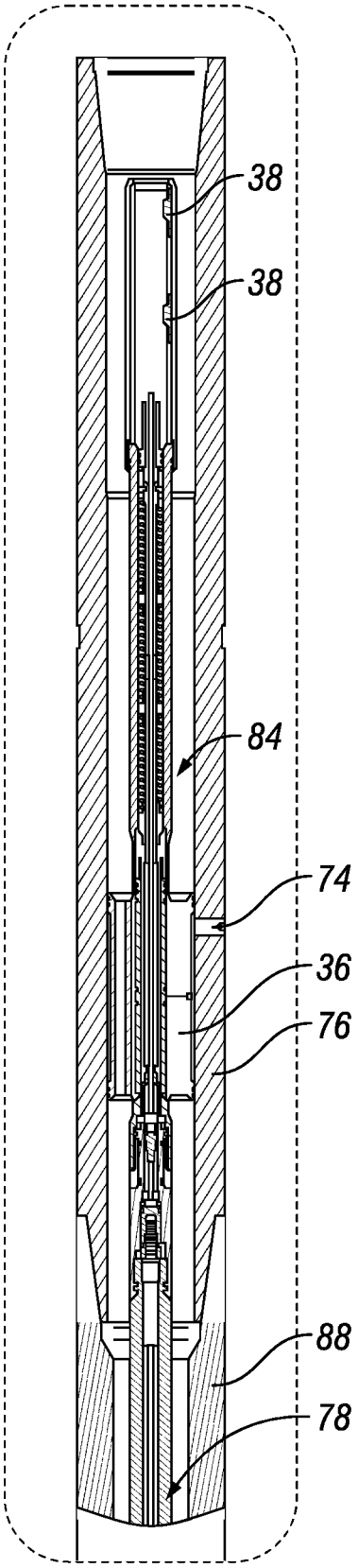

In FIGS. 7 and 7A, the adapter 84 may first be connected to the second downhole tool 78 (i.e., the resistivity tool), and the drill string 88 may then be extended by sliding a drill collar 76 around the centralizer ring 36 of the adapter 84 and threading the drill collar 76 to the collar of the resistivity tool. While the first portion of the adapter 84 may be affixed to the second downhole tool 78, the second portion of the adapter 84, including the centralizer ring 36 and the one or more keys 38, remain rotatable to the drill string 88. The operator may rotate the second portion of the adapter 84 relative to the first portion to orient the one or more keys 38 with the scribe line 80. Once the one or more keys 38 are correctly oriented, the operator may engage the centralizer ring 36 with the set screw 74 coupled to the wall of the drill collar 76 to hinder further rotation of the centralizer ring 36 and/or of the one or more keys 38 relative to the drill collar 76.

Figure 8:
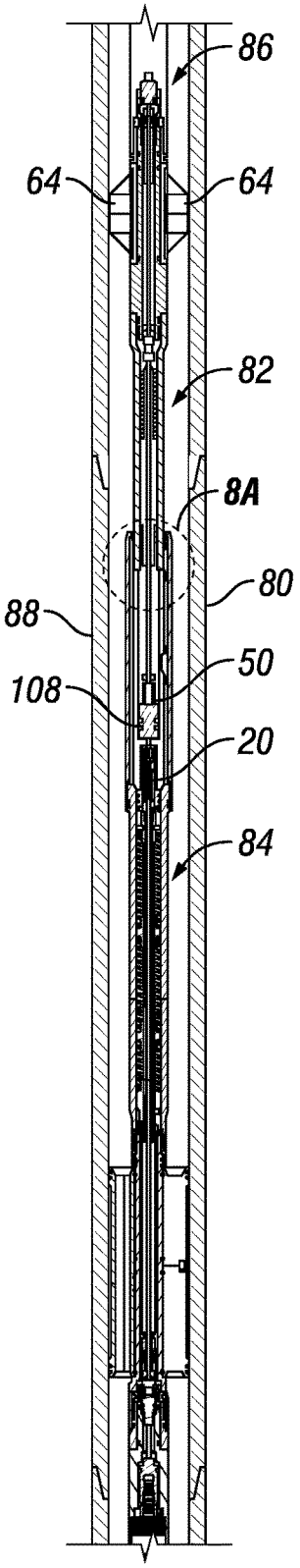
Figure 8A:
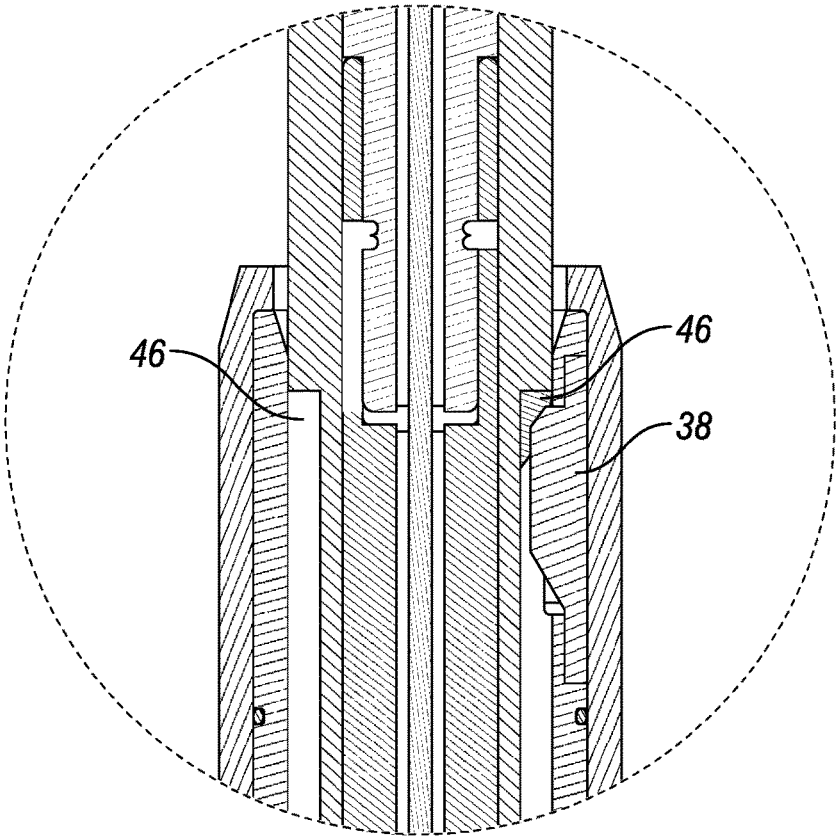

In FIGS. 8 and 8A, the drill string 88 may have been further extended. The centralizer 82 may first be connected to the first downhole tool 86 which forms part of the MWD tool string. Then the MWD tool string, including the first downhole tool 86 and the centralizer 82 may be suspended from a hoist and lowered into the drill string 88. The one or more keys 38 may engage one of the two helical surfaces 46 of the keyway. The engagement causes the centralizer 82 to rotate relative to the scribe line 80, thus aligning the sockets of first wet connector 50 with the pins of second wet connector 20 while simultaneously orienting the centralizer 82, the first downhole tool 86, and the MWD tool string with the scribe line 80. While the centralizer 82, the first downhole tool 86, and the MWD tool are oriented, the tubular body of the centralizer 82 may simultaneously rotate relative to the plurality of centralizer fins 64. Further, an inner surface 108 of the second centralizer housing 42 may engage the outer diameter the second wet connector 20. The engagement may preferably occur before the first wet connector 50 mates with the second wet connector 20, so that damage and/or bending of the pins on the second wet connector 20 may be prevented.

Figure 9:
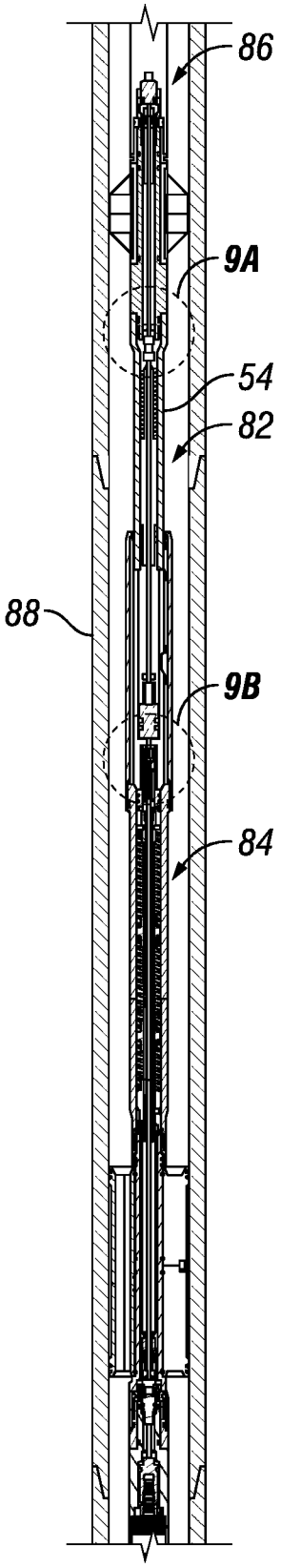
Figure 9A:
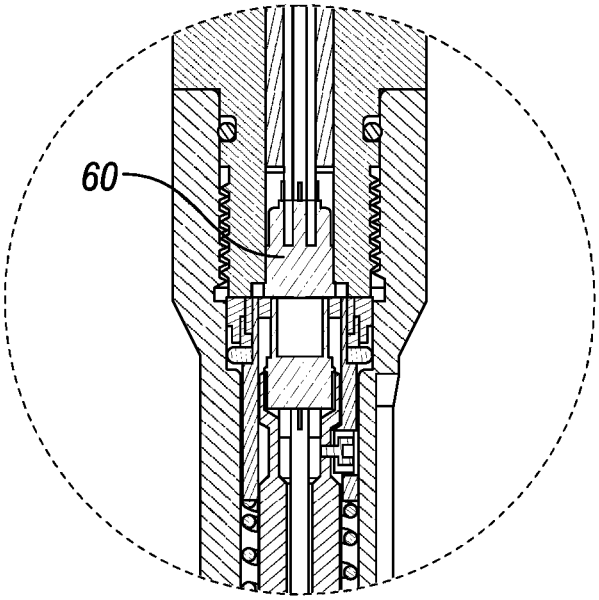
Figure 9B:
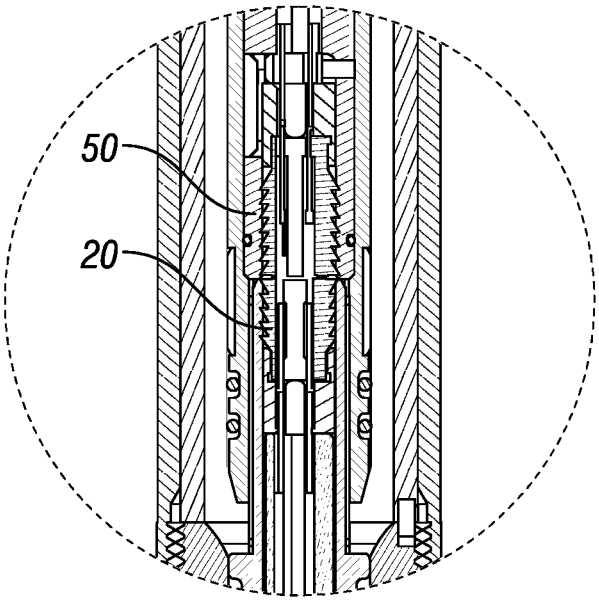

In FIGS. 9, 9A, and 9B, further lowering of the MWD tool string, including the first downhole tool 86 and the centralizer 82, may cause the first wet connector 50 to mate with the second wet connector 20 after the first connector is aligned with the second wet connector 20. However, the spring 54 may be sufficiently stiff maintain the first switch connector 58 in a first position wherein the first switch connector 58 is electrically insulated from the second switch connector 60. As such, the flow of electrical power between the MWD tool string and the resistivity tool may be prevented until the first wet connector 50 is fully mated with the second wet connector 20.

Figure 10:
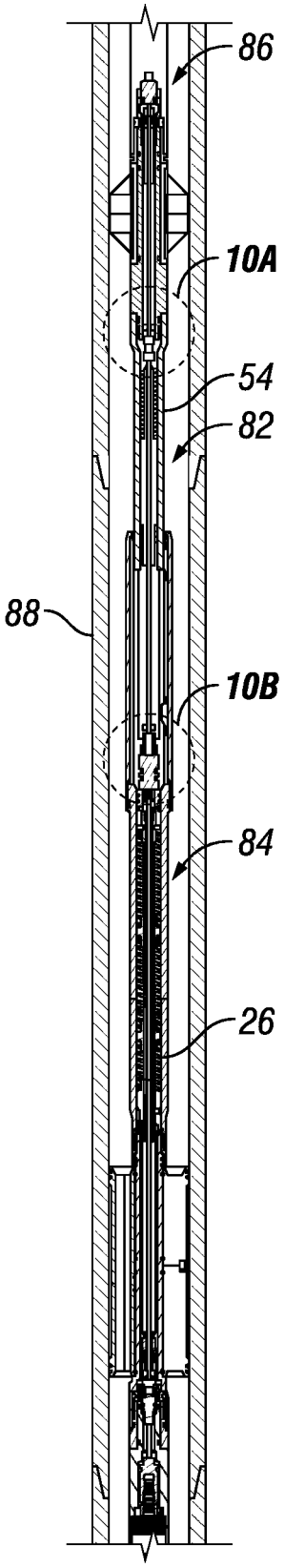
Figure 10A:
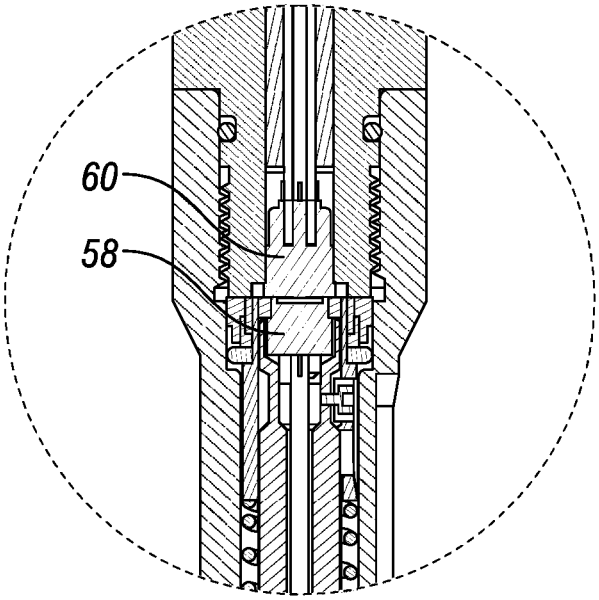
Figure 10B:
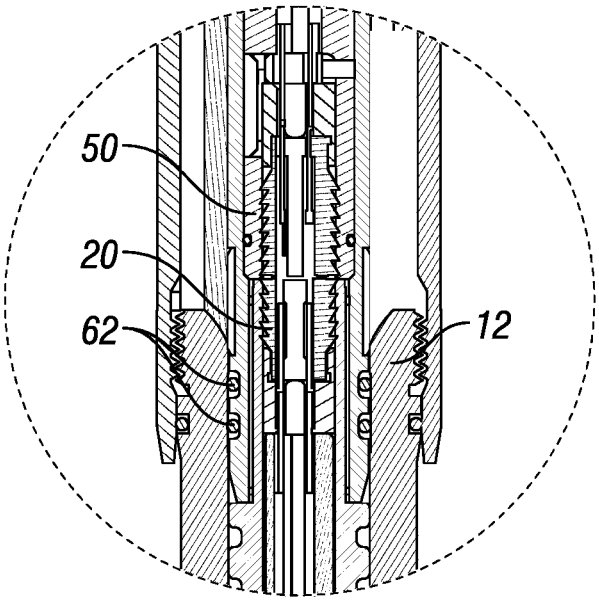

In FIGS. 10, 10A and 10B, still further lowering of the MWD tool string, including the first downhole tool 86 and the centralizer 82, may have caused the spring 54 to compress and the first switch connector 58 to move to a second position wherein the first switch connector 58 is electrically connected to the second switch connector 60. The spring 26 may preferably be stiffer than the spring 54. As such, the spring 26 may not compress until the first switch connector 58 has moved to the second position. Then, the spring 26 may compress to allow for some variation in the length of the collars of the drill string 88. Also, the O-rings 62 may preferably engage and seal against the first adapter housing 12 so that the first wet connector 50 and the second wet connector 20 may no longer be exposed to drilling fluids.

While the disclosure is susceptible to various modifications and alternative forms, specific embodiments thereof are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A system for connecting downhole tools, comprising:

a first tubular body;

a first wet connector disposed inside a first end of the first tubular body;

a second tubular body having a first portion and a second portion, the first portion being coupled to the second portion by a cylindrical or revolute joint;

a second wet connector disposed inside a second end of the second portion;

a centralizer ring disposed around the second portion, the centralizer ring being rotatably fixed relative to the second portion;

a drill collar having a bore sized to receive the centralizer ring and a wall coupled to a setting means, the setting means being engaged with the centralizer ring to hinder a rotation of the centralizer ring relative to the drill collar;

a key protruding from a first surface of one of the first end or the second end; and a keyway recessed from a second surface of the other of the first end or the second end, wherein either the key or the keyway is rotatably fixed relative to the second portion and the centralizer ring, wherein the key and the keyway are configured to align the first wet connector with the second wet connector and simultaneously orient the first tubular body in a predetermined direction after the key has engaged the keyway, and wherein the first wet connector is configured to electrically connect with the second wet connector.

2. The system of claim 1, wherein the keyway comprises a funnel surface including two helical surfaces having opposite handedness and two straight surfaces each adjacent to one of the two helical surfaces, wherein the helical surfaces are adjacent to an apex surface essentially diametrically opposed to the two straight surfaces.

3. The system of claim 1, further comprising:

a first rotatable connector coupled to the first portion; and a second rotatable connector coupled to the second portion, the first rotatable connector being electrically connected to the second rotatable connector, wherein the second wet connector is electrically connected to the second rotatable connector.

4. The system of claim 3, wherein the first rotatable connector and the second rotatable connector are sealed within the second tubular body by seals provided on the second wet connector and on a bulkhead.

5. The system of claim 1, further comprising a plurality of centralizer fins coupled around the first tubular body by a cylindrical or revolute joint.

6. The system of claim 1, further comprising:

a first switch connector disposed inside the first tubular body, the first switch connector being translatably fixed relative to the first wet connector, the first switch connector being electrically coupled to the first wet connector;

a second switch connector disposed inside the first tubular body, wherein the first switch connector being movable between a first position wherein the first switch connector is electrically insulated from the second switch connector and a second position wherein the first switch connector is electrically connected to the second switch connector; and a first biasing means capable of biasing the first switch connector in the first position.

7. The system of claim 6, wherein the first switch connector and the second switch connector are sealed within the first tubular body by seals provided on the first wet connector and on a bulkhead.

8. The system of claim 6, further comprising a second biasing means coupled to the second wet connector, wherein the second biasing means is stiffer then than the first biasing means.

9. The system of claim 1, wherein the first wet connector and the second wet connector form a multi-pin and multi-socket electrical connection.

10. A method for connecting downhole tools, comprising:

providing a first tubular body and a first wet connector disposed inside a first end of the first tubular body;

providing a second tubular body having a first portion and a second portion, the first portion being coupled to the second portion by a cylindrical or revolute joint, a second wet connector disposed inside a second end of the second portion, and a centralizer ring disposed around the second portion, the centralizer ring being rotatably fixed relative to the second portion;

receiving the centralizer ring in a bore of a drill collar;

providing a key protruding from a first surface of one of the first end or the second end, and a keyway recessed from a second surface of the other of the first end or the second end, rotating the second portion relative to the first portion to orient either the key or the keyway in a predetermined direction, selectively engaging the centralizer ring with a setting means coupled to the wall of the drill collar to hinder a rotation of the centralizer ring and the second portion relative to the drill collar;

engaging the key with the keyway;

aligning the first wet connector with the second wet connector while simultaneously orienting the first tubular body in the predetermined direction after the key has engaged the keyway; and electrically connecting the first wet connector with the second wet connector after the first wet connector is aligned with the second wet connector.

11. The method of claim 10, wherein the keyway comprises a funnel surface including two helical surfaces having opposite handedness and two straight surfaces each adjacent to one of the two helical surfaces.

12. The method of claim 10, further comprising:

providing a first rotatable connector coupled to the first portion; and a second rotatable connector coupled to the second portion, the first rotatable connector being electrically connected to the second rotatable connector, wherein the second wet connector is electrically connected to the second rotatable connector; and rotating the second rotatable connector relative to the first rotatable connector while simultaneously rotating the second portion relative to the first portion.

13. The method of claim 12, wherein the first rotatable connector and the second rotatable connector are sealed within the second tubular body by seals provided on the second wet connector and on a bulkhead.

14. The method of claim 10, further comprising:

providing a plurality of centralizer fins coupled around the first tubular body by a cylindrical or revolute joint;

receiving the plurality of centralizer fins in the bore of the drill collar; and rotating the first tubular body relative to the plurality of centralizer fins while simultaneously orienting the first tubular body in the predetermined direction.

15. The method of claim 10, further comprising:

providing a first switch connector disposed inside the first tubular body, the first switch connector being translatably fixed relative to the first wet connector, the first switch connector being electrically coupled to the first wet connector;

providing a second switch connector disposed inside the first tubular body, biasing the first switch connector in a first position wherein the first switch connector is electrically insulated from the second switch connector; and moving the first switch connector to a second position wherein the first switch connector is electrically connected to the second switch connector after the first wet connector is electrically connected with the second wet connector.

16. The method of claim 15, wherein the first switch connector and the second switch connector are sealed within the first tubular body by seals provided on the first wet connector and on a bulkhead.

17. The method of claim 15, further comprising:

providing a second biasing means coupled to the second wet connector; and compressing the second biasing means after the first switch connector has moved to the second position.

18. The method of claim 10, wherein the first wet connector and the second wet connector form a multi-pins and sockets electrical connection.

* * * * *